US006714115B1

(12) United States Patent
Kremers et al.

(10) Patent No.: US 6,714,115 B1
(45) Date of Patent: Mar. 30, 2004

(54) SELF-RECOVERING CURRENT LIMITING DEVICE WITH LIQUID METAL

(75) Inventors: Wolfgang Kremers, Bonn (DE); Andreas Kraetzschmar, Bonn (DE); Frank Berger, Swistal-Miel (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 10/031,255

(22) PCT Filed: Apr. 19, 2000

(86) PCT No.: PCT/EP00/03553

§ 371 (c)(1),
(2), (4) Date: Apr. 24, 2002

(87) PCT Pub. No.: WO00/65618

PCT Pub. Date: Nov. 2, 2000

(51) Int. Cl.[7] ..... H01H 87/00; H01H 29/02

(52) U.S. Cl. ..... 337/21; 337/119; 337/121; 337/167; 335/47; 335/49

(58) Field of Search ..... 337/21, 114, 119, 337/121, 122, 167; 335/47, 49, 50, 51, 57; 361/58; 29/622

(56) References Cited

U.S. PATENT DOCUMENTS

| | | | | | |
|---|---|---|---|---|---|
| 1,595,061 | A | * | 8/1926 | Valerius | 337/119 |
| 3,369,094 | A | * | 2/1968 | Langberg et al. | 337/154 |
| 3,644,860 | A | * | 2/1972 | Yamagata et al. | 337/21 |
| 3,699,489 | A | | 10/1972 | Imalyo | 337/221 |
| 3,806,855 | A | * | 4/1974 | Hurtle | 337/114 |
| 3,886,511 | A | * | 5/1975 | Miyamoto et al. | 337/119 |
| 3,991,396 | A | * | 11/1976 | Barkan | 337/114 |
| 4,429,295 | A | | 1/1984 | Wu | 337/119 |
| 4,598,332 | A | * | 7/1986 | Kemeny | 361/58 |
| 6,525,642 | B1 | * | 2/2003 | Kremers et al. | 338/80 |

FOREIGN PATENT DOCUMENTS

| | | | |
|---|---|---|---|
| DE | 395284 | 9/1923 | |
| DE | 2114879 | 10/1971 | |
| DE | 2652506 | 5/1978 | |
| DE | 4012385 | 3/1991 | |
| GB | 1209020 | 10/1971 | |
| JP | 404312737 | 11/1992 | |
| SU | 922911 | 4/1982 | |
| SU | 1529303 | 12/1989 | |
| WO | WO 48216 A1 * | 8/2000 | H01H/87/00 |

* cited by examiner

*Primary Examiner*—Anatoly Vortman
(74) *Attorney, Agent, or Firm*—Davidson, Davidson & Kappel, LLC

(57) ABSTRACT

A self-recovering device current limiting device with liquid metal includes two solid metal electrodes for connecting to an electric circuit to be protected. Several compression chambers partially filled with liquid metal are arranged one after the other between the electrodes. The compression chambers are formed by pressure-resistant insulating bodies and insulating intermediate walls supported by the insulating bodies. The insulating bodies include several connecting channels. To adjust the current limiting device to a desired nominal current factor, the level of the liquid metal above the connecting channels can be modified using an adjusting device. A reservoir is connected to the adjusting device, which can be adjusted and fixed in place externally.

13 Claims, 2 Drawing Sheets

SELF-RECOVERING CURRENT LIMITING DEVICE WITH LIQUID METAL

BACKGROUND

The present invention relates to a self-recovering current-limiting device with liquid metal, including electrodes made of solid metal for the connection to an electric circuit to be protected and a plurality of compression spaces which are partially filled with liquid metal.

Soviet Union Patent Publication SU 922 911 A describes a self-recovering current-limiting device containing two electrodes made of solid metal which are separated by first insulating bodies which are designed as a pressure-resistant insulating housing. Inside the insulating housing, compression spaces are formed by insulating intermediate walls and second insulating bodies which are arranged therebetween and designed as ring-shaped sealing disks, the compression spaces being partially filled with liquid metal and arranged one behind the other and interconnected via connecting channels of the intermediate walls, the connecting channels being filled with liquid metal and arranged off-center. Thus, in normal operation, a continuous, inner conductive connection exists between the electrodes via the liquid metal. In the current-limiting event, the liquid metal is displaced from the connecting channels as a result of the high current density. In this manner, the electrical connection of the electrodes via the liquid metal is interrupted, resulting in the limiting of the short-circuit current. Subsequent to clearing or eliminating the short circuit, the connecting channels refill with liquid metal whereupon the current-limiting device is operational again. In German Patent Application DE 40 12 385 A1, a current-limiting device having only one compression space is described and vacuum, protective gas, or an insulating liquid are mentioned as the medium above the liquid level. It is known from German Patent Application DE 26 52 506 A1 to use gallium alloys, in particular GaInSn alloys as liquid metal in contact devices. Known, for example, from Japanese Patent Abstract JP 40 4312737 A are, current-limiting devices in which a tubular current-limiting chamber filled with liquid metal is in communication with a gas-filled, spring-loaded cylinder-piston device for absorbing the sudden pressure increase developing in the current-limiting event due to the vaporization of liquid metal.

To enable the current-limiting devices mentioned at the outset to be used for different cases of application, they have to be differently designed to the effect that they do not operate in response to an overloading of more or less short duration, depending on the case of application. Thus, for example, in conjunction with generators, current-limiting devices must not operate in response to a short-time overload current which is 2 . . . 6 times the nominal current or, in conjunction with motors of poor iron quality or transformers, in response to a short-time overload current which is 6 . . . 18 times the nominal current, but have to operate only in response to a current which in comparison is higher. Until now, therefore, there has been the disadvantageous requirement for the manufacturers to offer a considerable number of current-limiting devices to permit a suitable selection with respect to the conditions on the user side.

U. S. Pat. No. 4,429,295 describes a self-recovering device current limiting device containing hollow cylindrical electrodes made of solid metal, two compression spaces which are completely filled with liquid metal, and an intermediate wall which separates the compression spaces and which features connecting channels. The electrodes, together with in each case one inner piston made of insulating material, constitute a cylinder-piston device for taking up the evaporating pressure in the current-limiting event against a restoring means in the form of an inert gas or a spring means. British Patent GB 1 209 020 discloses a self-recovering current-limiting device in which a fixed electrode and a movable electrode are conductively connected via a reservoir which is completely filled with liquid metal and via a connecting channel. In the current-limiting event, the movable electrode is moved by the pressure of vaporizing liquid metal against a gaseous restoring means, it being possible for a plunger which is linked to the movable electrode and protrudes outward to be connected to an actuator for an indicating means or a circuit-breaker. After the current-limiting event has ended, the condensing liquid metal causes the movable electrode to return to the original position together with the plunger. The above described current-limiting devices are not suitable for an adjustment to a desired nominal current factor. Soviet Union Patent Publication SU 1 529 303 A describes an electric switching device with liquid metal, both of whose electrodes of solid metal, together with an insulating intermediate piece, constitute a receptacle whose inner surface is provided with sections of different diameter. By actuating the piston of a bellows filled with liquid metal, the liquid level inside the receptacle rises or decreases, as a result of which an electrical connection or disconnection takes place between the electrodes. The above described switching device is not suitable for limiting an overcurrent.

SUMMARY OF THE INVENTION

Therefore, an object of the present invention is to provide a current-limiting device which can be adapted to a desired current-limiting behavior, i.e., in particular with respect to the response, or minimum trip, current, in a manner which is easy to handle and reliably reproducible.

The present invention provides a self-recovering current-limiting device. The device includes a first and a second electrode for connection to an electric circuit to be protected, each of the first and second electrodes being made of a respective solid metal. A plurality of pressure-resistant insulating bodies and a plurality of insulating intermediate walls supported by the plurality of insulating bodies are provided. The plurality of insulating intermediate walls define a plurality of connecting channels therein and the plurality of insulating intermediate walls and the plurality of pressure-resistant insulating bodies at least partially define a plurality of compression spaces. The plurality of compression spaces are disposed one behind the other between the first and second electrodes and are at least partially filled with a liquid metal, a level of the liquid metal above the connecting channels being changeable using an adjusting device.

By an adjustment of the adjusting device, a change in volume of the liquid metal inside the compression spaces is effected, changing the filling level above the connecting channels. It was found that the magnitude of the response current increases with increasing filling level of the liquid metal above the connecting channels, provided that the remaining conditions are identical. In this manner, it is achieved for an individual device to be adjustable to a required nominal current factor of a plurality of possible nominal current factors on the user side. The current-limiting device is intended to operate in response to the nominal current, which the installation to be protected is designed for, multiplied by the nominal current factor.

In a first embodiment of the present invention at least one of the compression spaces is at least partially designed as a cylinder-piston device whose piston and, consequently, the filling level can be adjusted by an adjustable and arrestable adjusting device. Advantageous in this context is the conductive connection of the piston to the adjacent electrode, for example, via welded-on flexible conductors so that the piston acts like an inner electrode.

In a second embodiment of the present invention at least one of the compression spaces is connected to a reservoir which is filled with liquid metal, the reservoir being operatively connected to an adjusting device which can be adjusted and arrested from outside. Preferably, one of the electrodes is in communication with the reservoir. The reservoir is advantageously constituted by a cylinder-piston device or of a bellows.

The adjusting device is expediently connected to a plunger and/or can be arrested by way of arresting or clamping means and/or is provided with an adjusting scale, in this case advantageously in conjunction with a pointer.

If a plurality of current-limiting devices are combined to form a multipole device, then it is recommendable for the adjusting devices of all poles to be connected for jointly adjusting the same nominal current factor of the poles, for example, via a bridge.

GaInSn alloys as the liquid metal to be used are easy to handle because of their physiological harmlessness. An alloy of 660 parts by weight of gallium, 205 parts by weight of indium, and 135 parts by weight of tin is liquid from 10° C. to 2000° C. at normal pressure and possesses sufficient electrical conductivity.

BRIEF DESCRIPTION OF THE DRAWING

Further details and advantages of the present invention ensue from the following exemplary embodiments which will be explained on the basis of Figures.

DETAILED DESCRIPTION

Figure 1A:
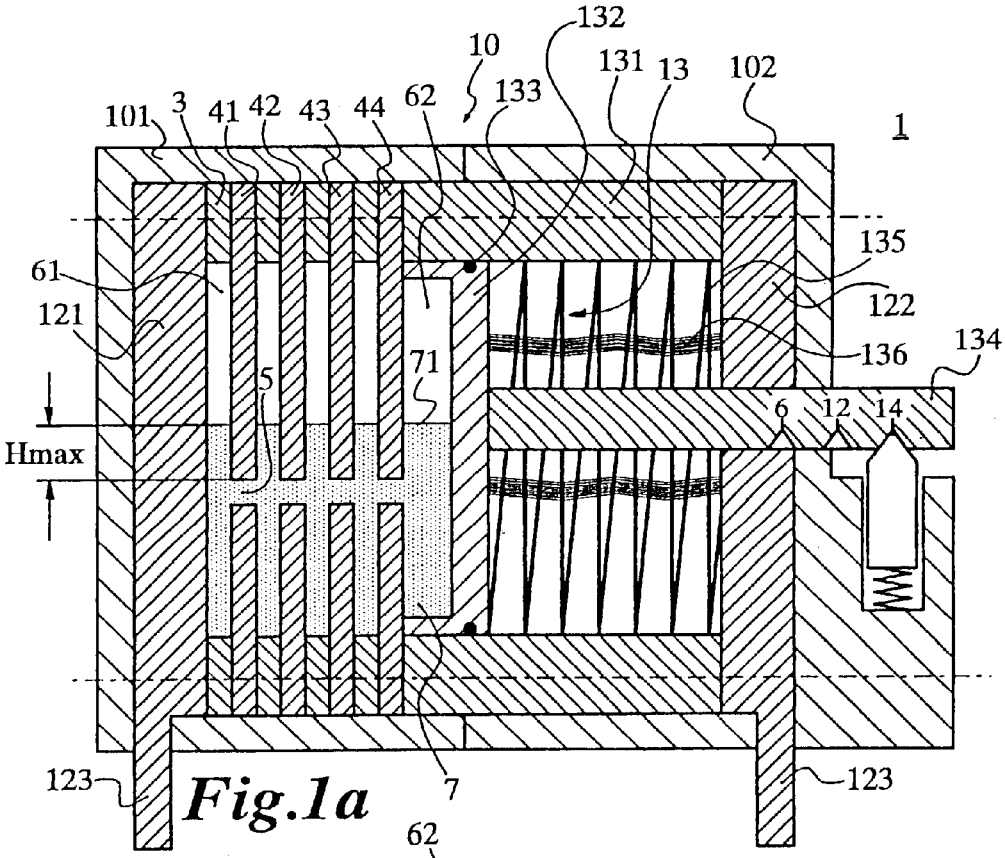
FIGS. 1*a, b* shows a longitudinal section of a first embodiment of the current-limiting device according to the present invention.
Figure 1B:
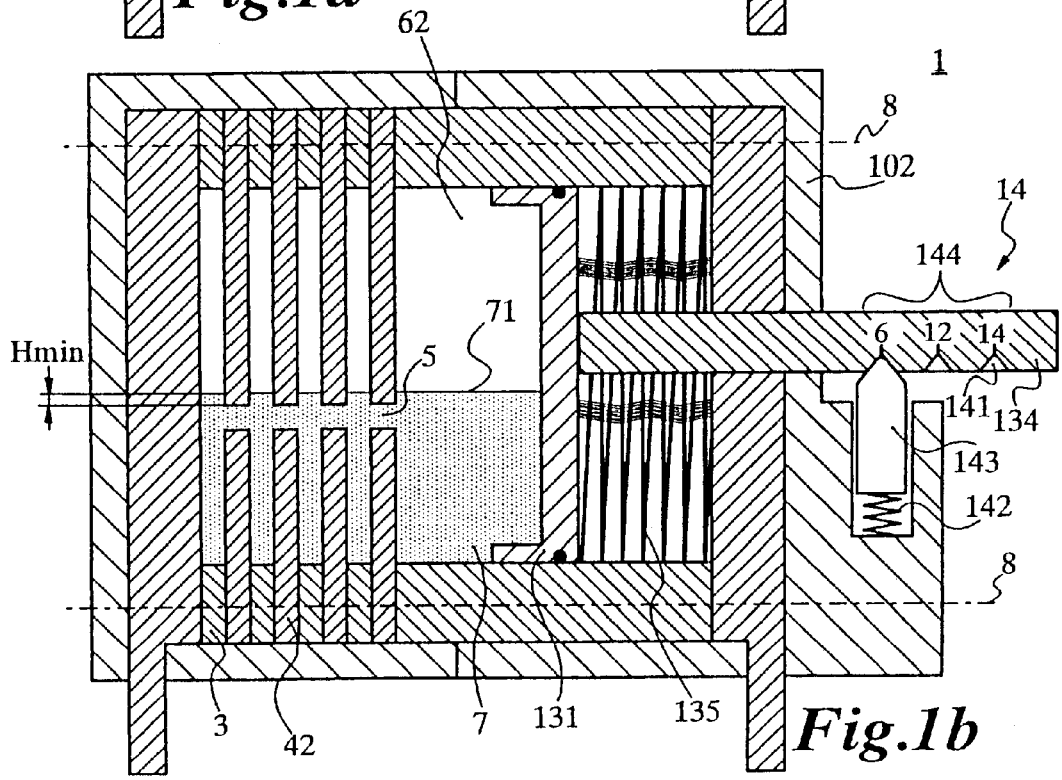

In the embodiment of the present invention according to FIG. 1 and FIG. 1*b*, current-limiting device 1 is enclosed by a pressure-resistant first insulating body in the form of a molded housing 10. Molded housing 10 is constituted by a half shell 101 on the left-hand side and a half-shell 102 on the right-hand side. Inside molded housing 10 are located a left-hand electrode 121 and a right-hand electrode 122. Electrodes 121 and 122 are composed of massive copper and protrude through molded housing 10 via an outer connecting conductor 123, respectively. Starting at left-hand electrode 121, pressure-resistant second insulating bodies in the form of ring-shaped sealing disks 3 and insulating intermediate walls 41 through 44, which are provided with connecting channels 5, are alternately arranged in molded housing 10.

A cylinder-piston device 13 is located between intermediate wall 44 situated furthest on the right and right-hand electrode 122. Cylinder-piston device 13 is essentially constituted by a pressure-resistant insulating cylinder 131 and a piston 132 which is guided therein in a direction perpendicular to intermediate walls 41 through 44. Cylinder 131 is supported in molded housing 10 in the same way as sealing disks 3 and intermediate walls 31 through 44, provision being made for means, which are not shown, for frictionally connecting these elements, for example, continuous clamping bolts along the two lines 8 and, preferably, for sealing rings between these elements. Piston 132, which is designed as an open hollow cylinder, is sealingly guided in cylinder 131 for which purpose a sealing ring 133 is provided at the lateral surface of piston 132. Plunger 134 of piston 132 protrudes through right-hand electrode 122 and half shell 102. Piston 132 moves against the force of a restoring spring 135 which is braced between piston 132 and right-hand electrode 122. Restoring spring 135 acts upon piston 132 in the direction of intermediate wall 44. Piston 132, which is also composed of copper, is conductively connected to right-hand electrode 122 via a flexible copper Litz wires 136 which are welded-on at both ends so that piston 132 acts like an electrode.

First compression spaces 61 having a constant volume are formed by sealing disks 3, left-hand electrode 121 and intermediate walls 41 through 44. A second compression space 62 having a variable volume is formed by intermediate wall 44 situated furthest on the right, cylinder 131 and the piston. All compression spaces 61 and 62 are partially filled with a liquid metal 7, for example, a GaInSn alloy. Liquid level 71 thereof is always situated above connecting channels 5 so that normally, a continuous conductive connection exists between electrodes 121 and 122 via liquid metal 7, piston 132 and copper Litz wires 136, the conductive connection being limited or interrupted only when the response current is exceeded. Located above liquid level 7 is a vacuum or a protective gas whose pressure was adjusted by the manufacturer.

When moving plunger 134, the resulting change in volume of compression space 62 causes liquid level 71 of the liquid metal 7, which is distributing itself, to change in all compression spaces 61, 62. In the leftmost or rightmost position of piston 132, liquid level 71 occupies the maximum height Hmax (FIG. 1*a*) or the minimum height Hmin (FIG. 1*b*) above connecting channels 5, respectively, under the assumption of the depicted horizontal position of use of current-limiting device 1. The height of liquid level 71 above connecting channels 5 influences the magnitude of the response current of current-limiting device 1. In the direction of its free end, plunger 134 is provided with snap-in grooves 141 which cooperate in a locking manner with a pointer 143 which is guided in right-hand half shell 102 and acted upon by a locating spring 142. Snap-in grooves 141 are associated with values of an adjusting scale 144. These values correspond to the values of the nominal current factors which can be adjusted via adjusting device 14 which is constituted by adjusting means 141 through 144. In the example, the nominal current factors "6" (FIG. 1*b*), "12", and "14" (FIG. 1*a*) can be adjusted.

Figure 2A:
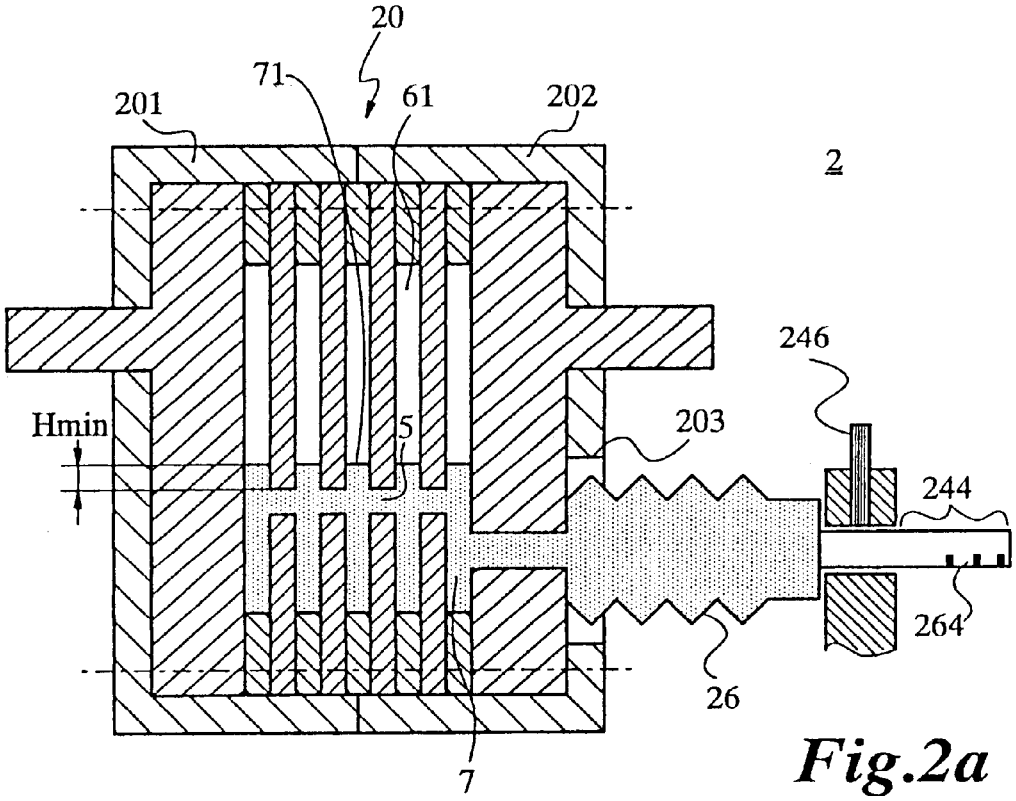
FIGS. 2*a, b* shows a longitudinal section of a second embodiment of the current-limiting device according to the present invention.
Figure 2B:
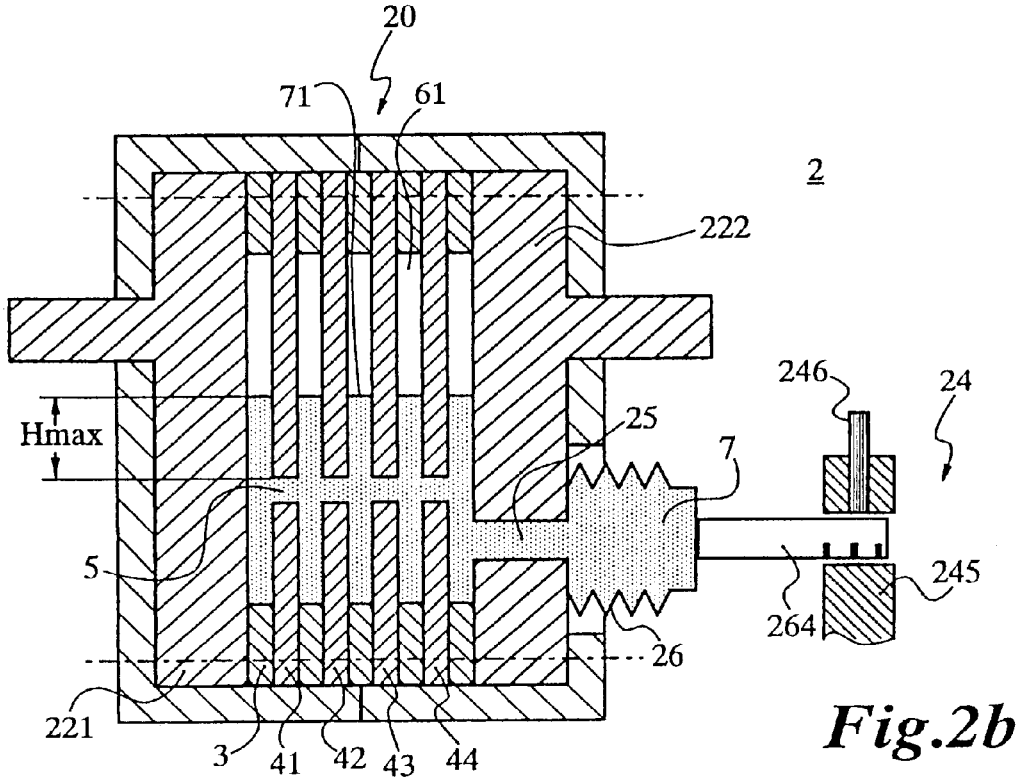

In the now following description and representation of current-limiting device 2 according to the embodiment of the present invention shown in FIG. 2*a* and FIG. 2*b*, only the significant differences from the embodiment shown in FIG. 1*a* and FIG. 1*b* will be pointed out, the same reference symbols being used for identical elements.

Left-hand electrode 221, sealing disks 3, intermediate walls 41 through 44 as well as right-hand electrode 222 form compression spaces 61 having a constant volume. Current-limiting device 2 is enclosed in an insulating and force-locking manner by a molded housing 20 composed of a left-hand and a right-hand half shell 201 and 202, respectively. Via a connecting port 25, compression spaces 61 are in communication with a reservoir 26 which is preferably completely filled with liquid metal 7. Reservoir 26 is designed as a (for example, metallic) bellows which is sealingly joined to the outside of right-hand electrode 222 in the region of an admission aperture 203 in right-hand half shell 202. The free end face of reservoir 26 is connected to a plunger 264 which is movably guided in a stationary bearing 245. When plunger 264 is moved to its rightmost position, reservoir 26 takes up its largest volume, involving a taking in of liquid metal 7 from compression spaces 61 as a result of which liquid level 71 occupies the smallest adjustable height Hmin above connecting channels 5 (FIG. 2*a*). When plunger 264 is moved to its leftmost position, reservoir 26 takes up its smallest volume, involving a delivery of liquid metal 7 into compression spaces 61 as a result of which liquid level 71 occupies the largest adjustable height Hmax above connecting channels 5 (FIG. 2*b*). For a defined adjustment, plunger 264 is provided with an adjusting scale 244. Using adjusting device 24 which is composed of adjusting means 244 through 246, it is possible to adjust liquid level 71 to any arbitrary height between Hmin and Hmax and thus, to adjust in a continuous manner, the nominal current factor of current-limiting device 2.

The present invention is not limited to the specific embodiments described above but is intended to be defined in scope by the appended claims. Thus, current-limiting device 2 can be modified to the effect that a cylinder-piston device is provided for reservoir 26 in lieu of a bellows. A further possible embodiment consists in that, when using a plurality of current-limiting devices 1 or 2 arranged in parallel to form a multipole device, plungers 134 of cylinder-piston devices 13 or plungers 264 of reservoirs 26 are rigidly connected to each other, only one adjusting device 14 or 24 being required here for all poles of the multipole current-limiting device. Moreover, it is possible for current-limiting device 1 to be modified in such a manner that copper Litz wires 136 are directly connected to right-hand connecting conductor 123 while right-hand electrode 122 is omitted.

What is claimed is:

1. A self-recovering current-limiting device comprising:

a first and a second electrode for connection to an electric circuit to be protected, each of the first and second electrodes being made of a respective solid metal;

a plurality of pressure-resistant insulating bodies; and a plurality of insulating intermediate walls supported by the plurality of insulating bodies;

wherein the plurality of insulating intermediate walls define a plurality of connecting channels therein and wherein the plurality of insulating intermediate walls and the plurality of pressure-resistant insulating bodies at least partially define a plurality of compression spaces, the plurality of compression spaces being disposed one behind the other between the first and second electrodes and being at least partially filled with a liquid metal, a level of the liquid metal above the connecting channels being changeable using an adjusting device.

2. The self-recovering current-limiting device as recited in claim 1 wherein:

at least a first compression space of the plurality of compression spaces is partially defined by a cylinder-piston device, the cylinder-piston device sealing the at least first compression space, a piston of the cylinder-piston device being at least partially covered with the liquid metal and being operatively connected to the adjusting device; and the adjusting device is adjustable and capable of being fixed in a position from outside the self-recovering current-limiting device.

3. The self-recovering current-limiting device as recited in claim 2 wherein the piston is disposed adjacent to and electroconductively connected to the first electrode, the piston being movable in a direction perpendicular to the plurality of insulating intermediate walls.

4. The self-recovering current-limiting device as recited in claim 1 further comprising a reservoir filled with liquid metal and having a variable volume, the reservoir being operatively connected to the adjusting device, and wherein the adjusting device is adjustable and capable of being fixed in a position from outside the self-recovering current-limiting device and wherein at least a first compression space of the plurality of compression spaces is connected to the reservoir.

5. The self-recovering current-limiting device as recited in claim 4 wherein the reservoir communicates with the first compression space via a connecting port defined by the first electrode, the first compression space being disposed adjacent to the first electrode.

6. The self-recovering current-limiting device as recited in claim 4 wherein the reservoir includes a cylinder-piston device which seals the first compression space.

7. The self-recovering current-limiting device as recited in claim 4 wherein the reservoir includes a bellows.

8. The self-recovering current-limiting device as recited in claim 1 wherein the adjusting device includes a plunger.

9. The self-recovering current-limiting device as recited in claim 1 wherein the adjusting device capable of being fixed in a plurality of positions using at least one of an arresting device and a clamping device.

10. The self-recovering current-limiting device as recited in claim 1 wherein the adjusting device includes an adjusting scale for adjusting a current-limiting characteristic of the self-recovering current-limiting device.

11. The self-recovering current-limiting device as recited in claim 10 wherein the adjusting device includes a pointer for the adjusting scale.

12. The self-recovering current-limiting device as recited in claim 1 wherein the self-recovering current-limiting device is associated with a first pole and wherein the adjusting device is connected to at least one second adjusting device associated with at least one second current-limiting device associated with at least one second pole, the at least one second current-limiting device being adjacent to and integrated with the self-recovering current-limiting device.

13. The current-limiting device as recited in claim 1 wherein the liquid metal includes an alloy of GaInSn.

* * * * *